US005829371A

United States Patent [19]

Schueler et al.

[11] Patent Number: 5,829,371

[45] Date of Patent: Nov. 3, 1998

[54] BUTTONHOLE OR EYELET SEWING MACHINE

[75] Inventors: Peter K. Schueler, Hawthorne; Pedro Silva, Carteret, both of N.J.

[73] Assignee: Clinton Industries, Inc., Carlstadt, N.J.

[21] Appl. No.: 873,076

[22] Filed: Jun. 11, 1997

[51] Int. Cl.[6] ..... D05B 3/06

[52] U.S. Cl. ..... 112/67; 112/470.12

[58] Field of Search ..... 112/475.25, 65, 112/66, 67, 68, 70, 73, 76, 470.12, 470.13

[56] References Cited

U.S. PATENT DOCUMENTS

| | | | |
|---|---|---|---|
| 3,943,864 | 3/1976 | Feighery et al. | 112/470.12 |
| 4,181,083 | 1/1980 | Bajer et al. . | |
| 4,495,878 | 1/1985 | Asai et al. . | |
| 4,502,401 | 3/1985 | Asai et al. . | |
| 4,696,245 | 9/1987 | Kato et al. . | |
| 4,712,496 | 12/1987 | Brown et al. . | |
| 4,759,302 | 7/1988 | Yanagi . | |
| 4,817,543 | 4/1989 | Fisher | 112/470.13 |
| 5,125,349 | 6/1992 | Koie et al. . | |
| 5,222,449 | 6/1993 | Koie et al. . | |
| 5,711,236 | 1/1998 | Badger | 112/470.13 |

FOREIGN PATENT DOCUMENTS

WO 96/10110 4/1996 WIPO .

*Primary Examiner*—Peter Nerbun
*Assistant Examiner*—Tejash D. Patel
*Attorney, Agent, or Firm*—Darby & Darby

[57] ABSTRACT

A buttonhole or eyelet sewing machine includes a housing. A machine head is slidably mounted on the housing and moves between a home position and a sew position. A bed plate is slidably mounted on the housing. A needle mechanism is mounted on the machine head and is movable in a reciprocal manner with respect to the housing. A first motor is mounted on the housing. The first motor directly drives the machine head between the home position and the sew position. A second motor is mounted on the housing. The second motor directly drives the needle mechanism. The second motor directly drives the bed plate to permit stitching about a buttonhole or eyelet.

10 Claims, 4 Drawing Sheets

12
18
16
10
56
14
46
20
64
22
40
42
24
64

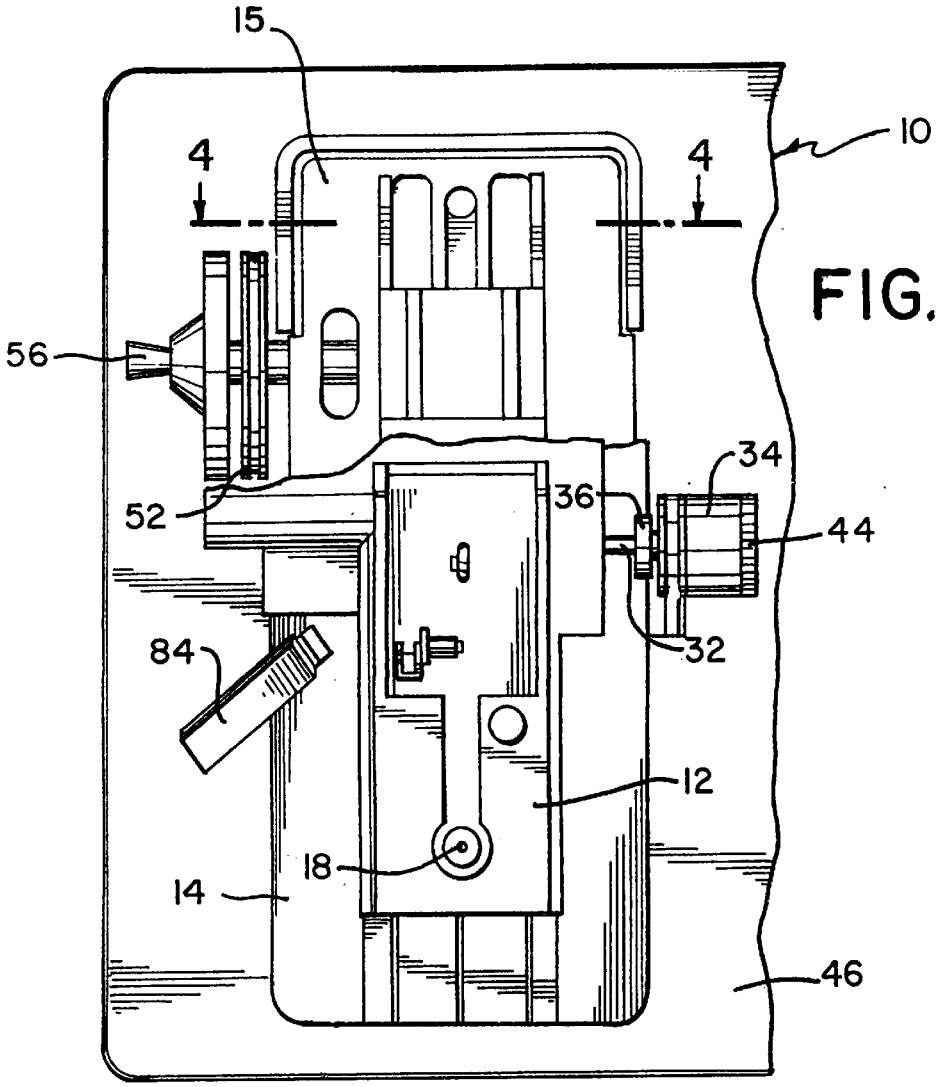
FIG. 3B
FIG. 4
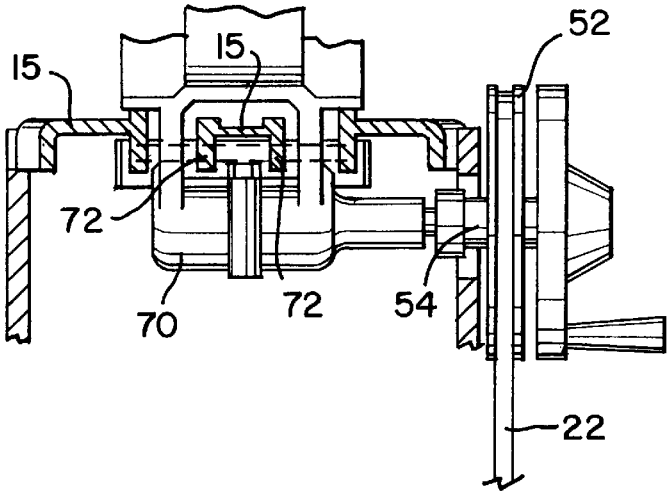

BUTTONHOLE OR EYELET SEWING MACHINE

BUTTONHOLE OR EYELET SEWING MACHINE

1. Field of the Invention

The present invention relates to a buttonhole or eyelet sewing machine. More specifically, the present invention relates to a buttonhole or eyelet sewing machine having a first motor to directly drive the machine head and a second motor to directly drive the needle mechanism.

2. Background of the Invention

Buttonhole sewing machines per se are known. For example, a buttonhole sewing machine is currently available from the Reece Corporation of Gorham, Me. and is sold under the name "Buttonhole Sewing Machine Series 104–100". The service manual and parts list for this series 104–100 buttonhole sewing machine are hereby incorporated by reference.

This buttonhole sewing machine is driven by a single motor. Because only one motor is used, complex machinery is required to actuate both the bed plate and the needle bar mechanism. For example, the Reece 104–100 buttonhole sewing machine uses two clutches to cause the motor to engage either the bed plate or the needle bar mechanism. Additionally, a brake is required so that the sewing head can be maintained in a predetermined fixed position.

Because the Reece 104–100 buttonhole sewing machine utilizes complex machinery it operates at a relatively high noise level and is subject to significant downtime whenever maintenance is required. Parts such as clutches and brakes will inherently wear down over time and must be replaced on a regular basis. However, due to the complex machinery a generally qualified machinery mechanic does not have the necessary skills required to replace the clutches or the brake in this buttonhole sewing machine in a satisfactory amount of time. Accordingly, a specially skilled mechanic, who is familiar with the Reece 104–100 machine, is required to replace either the clutches, brake or other components in the Reece 104–100 machine.

Clearly, there is a need in the art to provide a buttonhole or eyelet sewing machine which is subject to less downtime and operates at a relatively quiet noise level. To meet this need, Reece has attempted to modify their buttonhole sewing machine to overcome some of these problems. One attempt included using a reversible motor that included a pair of one-way clutches attached to it. One one-way clutch was used to drive the bed plate and the other one-way clutch was used to drive the needle bar mechanism. However, in order for this machine to operate properly a brake was required to stop the motor within 3 degrees of accuracy. Unfortunately, after only a relatively short period of use the brake could no longer stop the motor within the required 3 degrees of accuracy. Thus, this modified Reece 104–100 machine resulted in a buttonhole sewing machine that required more maintenance and had even larger amounts of downtime.

SUMMARY OF THE INVENTION

It is an object of the present invention to create a buttonhole or eyelet sewing machine which eliminates the need to use clutches or brakes to drive the bed plate or the needle bar mechanism. Additionally, it is further object of the present invention to provide a buttonhole or eyelet sewing machine that requires less maintenance and is subject to less downtime and operates at a lower noise level.

In accordance with a preferred embodiment demonstrating further objects, features and advantages of the invention, a buttonhole or eyelet sewing machine includes a housing with a machine head being slidably mounted on the housing such that the bed plate moves between a home position and a sew position. A bed plate is slidably mounted on the housing. A needle mechanism is mounted on the machine head and is movable in a reciprocal manner with respect to the housing. A first motor is mounted on the housing. The first motor directly drives the machine head between the home position and the sew position. A second motor is also mounted on the housing. The second motor directly drives the needle mechanism. The second motor directly drives the bed plate to permit stitching about a button hole.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

FIGS. 3A and 3B are partially sectioned top views of the buttonhole or eyelet sewing machine in accordance with the present invention; and FIG. 4 is a cross-sectional view taken along lines 4—4 of FIG. 3A and looking in the direction of the arrows.

DETAILED DESCRIPTION OF THE EXEMPLARY EMBODIMENTS

Figure 1:
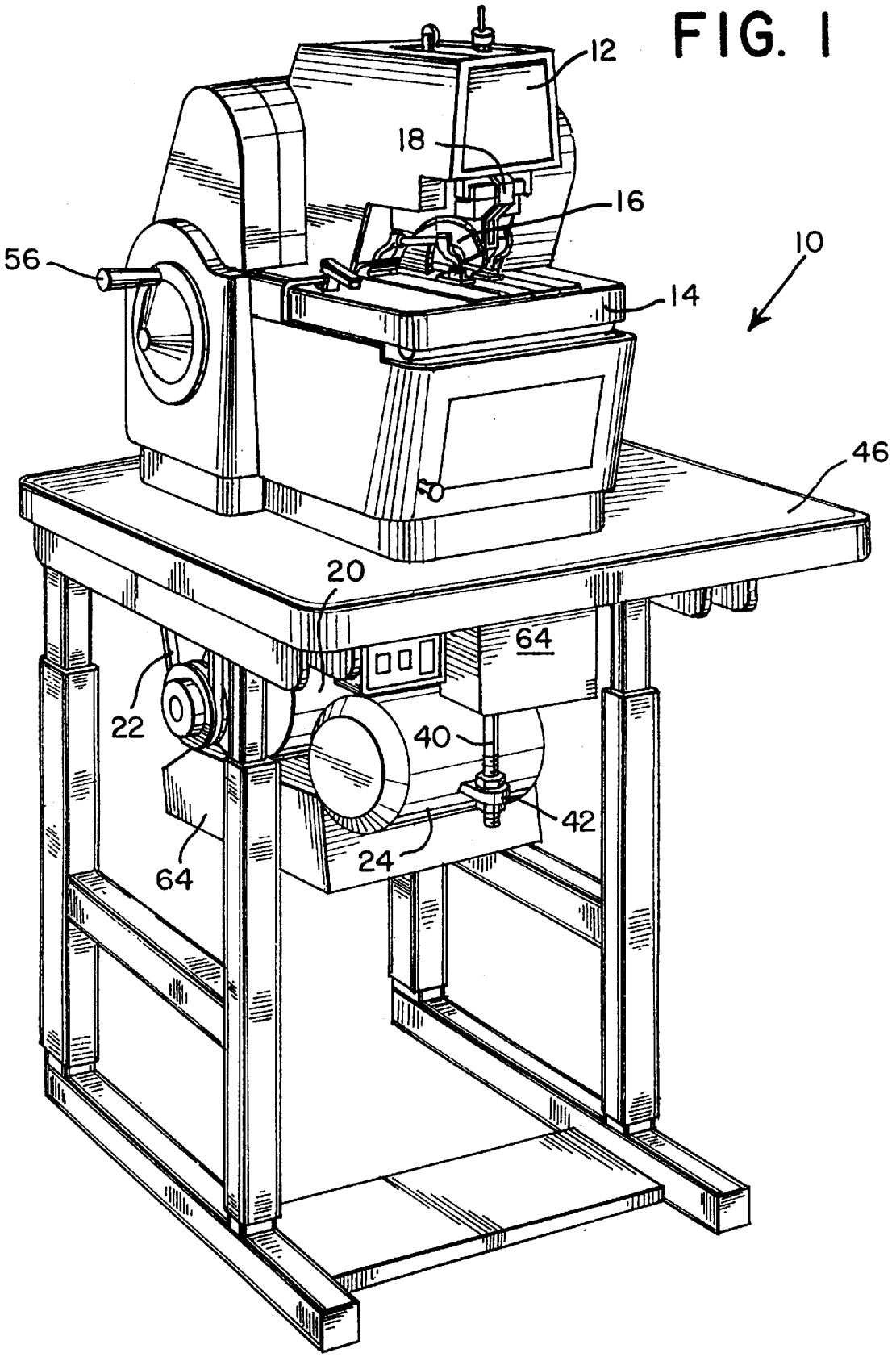
FIG. 1 is a perspective view of a buttonhole or eyelet sewing machine according to the present invention.

Referring now to FIG. 1, a buttonhole or eyelet sewing machine 10 having a housing 12 is illustrated. This buttonhole sewing machine is a modification and an improvement of the Reece series 104–100 buttonhole sewing machine. Accordingly, many of the parts of the present invention function similarly to the Reece machine and for the sake of brevity, the description of those parts has been omitted. Additionally, this buttonhole or eyelet sewing machine relates to our previously patented Buttonhole Sewing Machine, U.S. Pat. No. 5,524,561 to Schueler et al., the disclosure of which is hereby fully incorporated by reference.

A bed plate 14 is slidably mounted on housing 12. Housing 12 comprises the fixed frame of the sewing machine. A cutting lever 16 is pivotally mounted on housing 12. Because cutting lever 16 is mounted in a conventional manner, and for the sake of clarity, cutting lever 16 will not be illustrated in the remaining drawing Figures. A needle bar mechanism 18 (see FIGS. 1 and 2) is mounted on housing 12 in such a manner that it is movable up and down in a reciprocal manner with respect to housing 12.

Figure 3A:
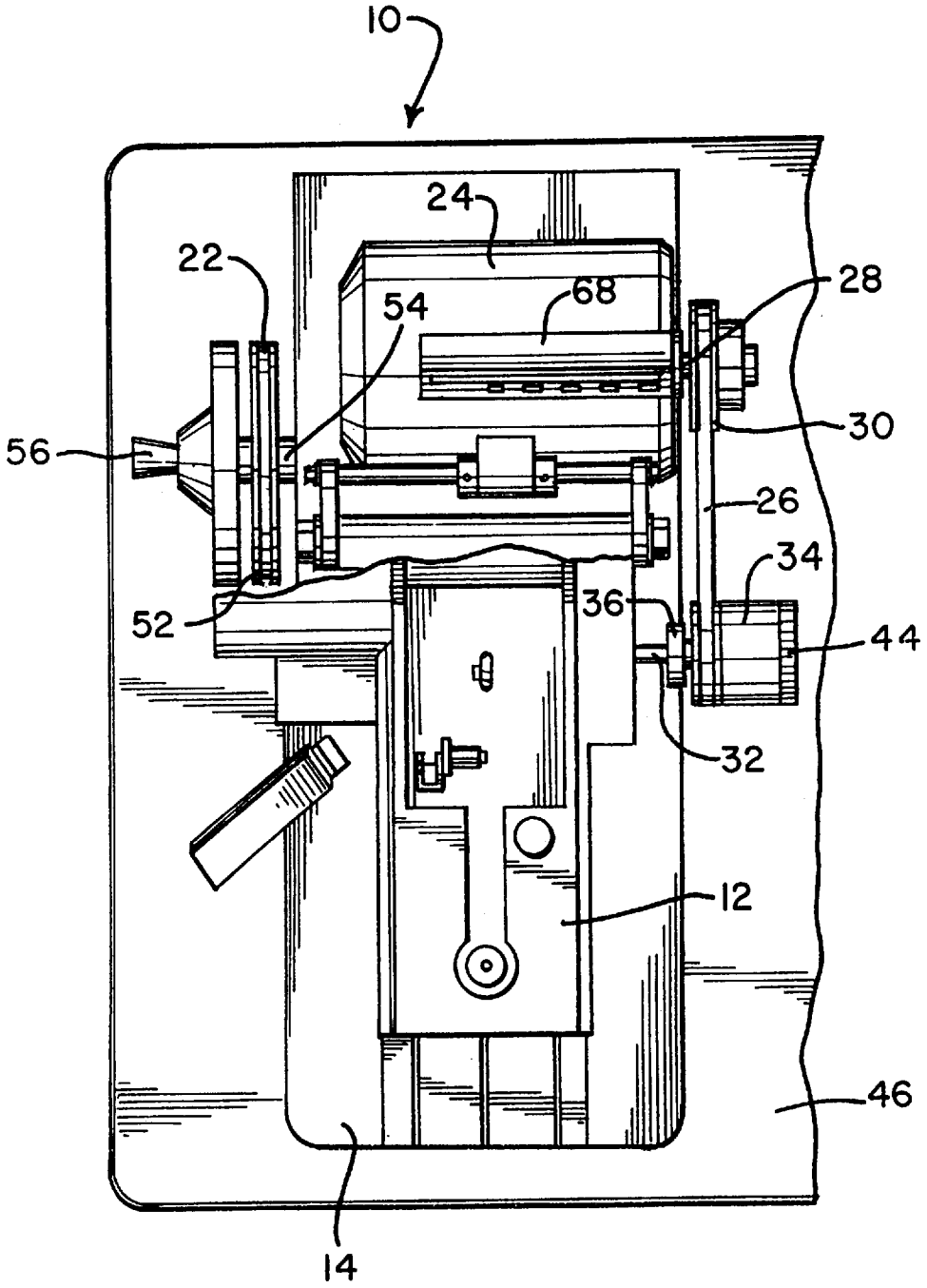

A second D.C. brushless motor 24 is mounted on housing 12 (below table 46). The second motor 24 directly drives the needle bar mechanism 18 in a reciprocal manner with respect to housing 12, via belt drive 26. As illustrated in FIG. 3A, second motor 24 rotates shaft 28 which is fixedly connected to pulley 30. Belt 26 transmits the rotary force from motor shaft 28 to the needle bar mechanism actuating shaft 32. Shaft 32 is fixedly connected to pulley 34 which is rotatably driven by belt 26. A cam 36 is fixedly connected to shaft 32. Cam 36 slidably engages with bed plate 14 to cause the bed plate to move about the periphery of the buttonhole or eyelet to be sewn. Thus, rotation of shaft 32 causes the actuation of the needle bar mechanism 18 and simultaneously causes the bed plate 14 to move a distance substantially equal to the length of the stitch to permit the needle bar mechanism to stitch about the periphery of the buttonhole or eyelet. Pulley 34 is also provided with a knurled outer periphery 44 on its opposite axial end. Knurled outer periphery 44 permits the user to manually rotate shaft 32 for maintenance purposes.

Figure 2:
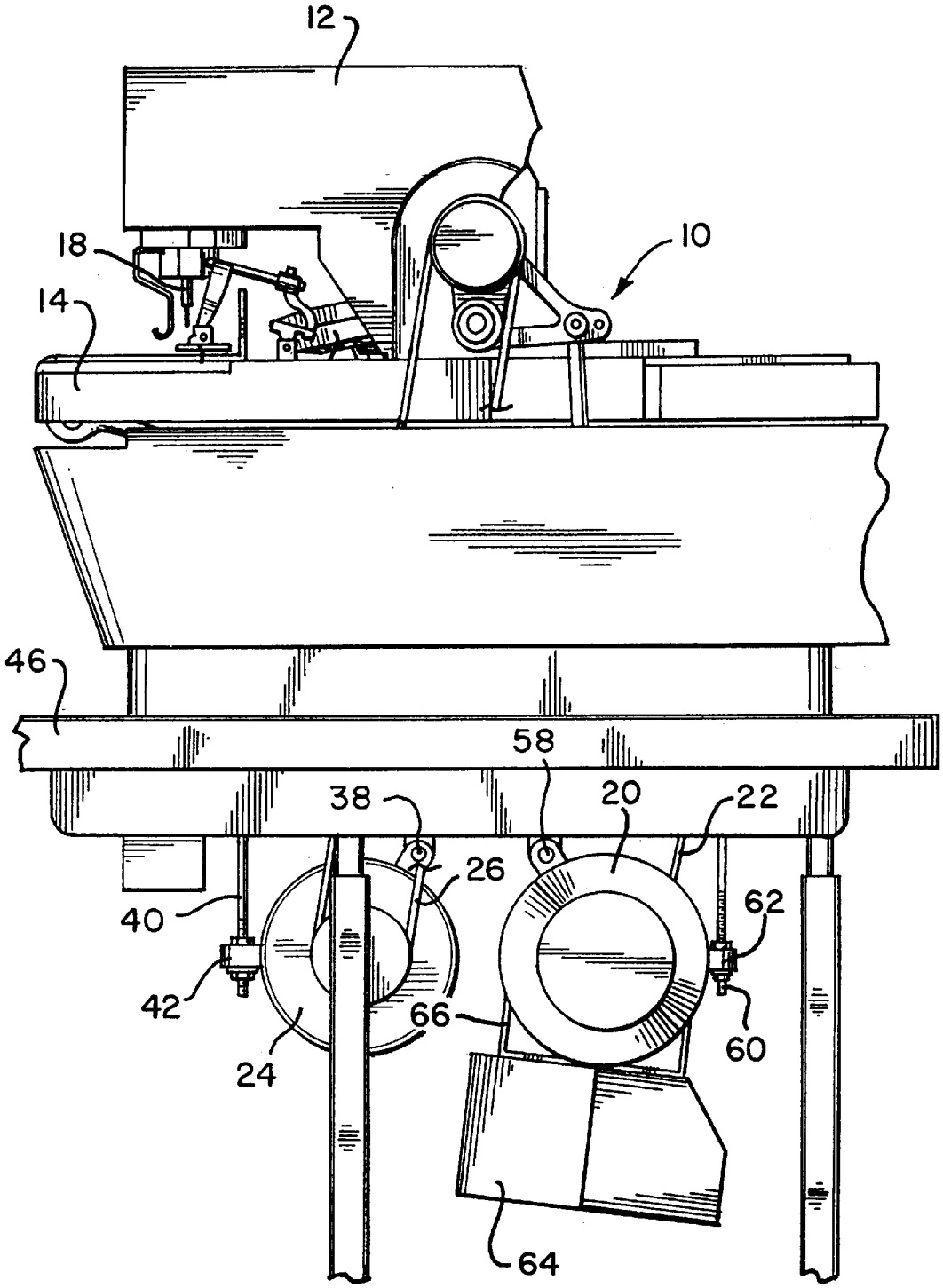
FIG. 2 is a side view of the buttonhole or eyelet sewing machine illustrated in FIG. 1.

Referring now to FIG. 2, to adjust the tension on belt 26, motor 24 is pivotally mounted to housing 12 about pivot point 38. A threaded rod 40 receives an internally threaded mounting bracket 42 which is mounted on motor 24. Accordingly, by rotating a nut within running bracket 42, motor 24 can be pivoted toward or away from housing 12 to vary the tension on belt 26 to a preferred level.

A first D.C. brushless motor 20 is mounted to housing 12 by being mounted below table 46. Motor 20 rotates a motor shaft (not shown) which is fixedly connected to a pulley (not shown). As illustrated in FIGS. 3B and 4, belt 22 directly transmits the rotary force from the motor shaft to pulley 52 which is fixedly mounted on shaft 54. Rotation of shaft 54 actuates a cam 70 that engages a cam follower 72 on machine head 15 to move machine head 15, which houses the needle mechanism 18, between the home position and the sew position. Thus, needle mechanism 18 moves between the home position and the sew position, with machine head 15, upon rotation of shaft 54. In addition, handle wheel 56 is fixedly attached to shaft 54 to permit the user to manually rotate this shaft for maintenance purposes.

Referring now to FIG. 2, motor 20 includes a belt tensioning adjustment mechanism similar to the mechanism used to adjust belt 26 of the first motor 24. Motor 20 is pivotally mounted to the housing 12 about pivot point 58. Threaded rod 60 receives an internally threaded mounting bracket 62 which is mounted on motor 20. Accordingly, by rotating a nut within mounting bracket 62, motor 20 can be pivoted toward or away from table 46 to vary the tension on belt 22.

A control unit 64 is mounted below motor 20 by a pair of brackets 66. An additional portion of the control unit 64, as illustrated in FIG. 1, can be mounted directly below table 46. Control unit 64 has a display 68 mounted on top of first motor 24. Control unit 64 is programmed to control the actuation of the first motor 20 and the second motor 24. Because the movement of the machine head 15 between the home position, the sew position and the cutting position takes place independently of the actuation of the needle bar mechanism 18, it is preferred that the control unit controls the actuation of only one motor at any given time. In other words, in an operating sequence, assuming that the machine head is in the home position, control unit 64 will actuate motor 20 to cause the machine head to move to the sew position. Thereafter, the control unit will no longer actuate motor 20 and will begin to control the actuation of second motor 24 to begin the stitching operation. Once the stitching operation is complete, that is, once the entire periphery of the buttonhole or eyelet has been sewn, control unit 64 will stop the actuation of motor 24. Thereafter, control unit 64 will again cause actuation of motor 20 to move the machine head 15 to the cutting position. Once the bed plate 14 is in the cutting position, cutting lever 16 is actuated to cut the buttonhole or eyelet in the fabric. Thereafter, the control unit 64 actuates motor 20 once again to move the machine head back to the home position. It should be noted that, as is conventional with buttonhole sewing machines, the cutting step can take place either before or after the stitching process.

The operator may control the operation of the buttonhole sewing machine by inputting, via display unit 68, that the motors are to be controlled to operate through either a full cycle, a single step (to move the machine head only), or for a repair cycle. The full cycle for the buttonhole sewing machine is the normal operating sequence and has been described above. The single step can be used to aid a mechanic when servicing the machine by permitting the machine to advance at only one operating sequence step at a time. The repair cycle permits the operator to move the second motor 24 at various speeds. For example, the speed of motor 24 can be controlled to be between a range of 80 to 2,000 rpm, with a normal operating speed being between 1250–1500 rpm. However, by operating the second motor at the very low speed of 80 rpm, the operator can position the needle at a precise position about the buttonhole. Thus, if for any reason the stitching cycle were to be interrupted, the operator could turn off the machine, correct the malfunction to the sewing machine, and then utilize the repair cycle to reposition the needle at the precise position necessary to insure that the buttonhole is properly sewn about the entire periphery. Accordingly, once the precise position about the buttonhole has been reached, the operator would then reset the control unit display to the full cycle setting to permit the buttonhole to be sewn and cut in the normal manner.

Having described the presently preferred exemplary embodiment of a new and improved buttonhole or eyelet sewing machine, in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

We claim:

1. A buttonhole or eyelet sewing machine comprising:

a housing;

a machine head being slidably mounted on said housing between a home position and a sew position;

a bed plate being slidably mounted on said housing;

a needle mechanism being mounted on said machine head and being movable in a reciprocal manner with respect to said housing;

a first motor being mounted on said housing, said first motor directly driving said machine head between said home position and said sew position; and a second motor being mounted on said housing, said second motor directly driving said needle mechanism, said second motor has means for directly driving said bed plate to permit stitching about a buttonhole or eyelet.

2. A buttonhole or eyelet sewing machine according to claim 1 further including a control unit having means for controlling the actuation of said first motor and said second motor.

3. A buttonhole or eyelet sewing machine according to claim 2, wherein said controlling means controls the actuation of only one of said first motor and said second motor at any given time.

4. A buttonhole or eyelet sewing machine according to claim 2, wherein said controlling means controls the actuation of said second motor between a rotational speed ranging from 80 rpm to 2000 rpm.

5. A buttonhole or eyelet sewing machine according to claim 1 further including a clamping arm having means for selectively holding a fabric securely on a top surface of said bed plate.

6. A buttonhole or eyelet sewing machine according to claim 5, wherein said selective holding means is pneumatically actuated.

7. A buttonhole or eyelet sewing machine according to claim 6, wherein said holding means includes a switch mounted on said top surface of said bed plate.

8. A buttonhole or eyelet sewing machine according to claim 1, wherein said direct driving means includes a cam being mounted on a rotating shaft to effect a movement of said bed plate about a periphery of said buttonhole.

9. A buttonhole or eyelet sewing machine according to claim 2, wherein said first motor and said second motor are electric motors.

10. A buttonhole or eyelet sewing machine according to claim 9, wherein said electric motors are rotary encoded D.C. brushless motors.

* * * * *